US006220015B1

(12) United States Patent
Mina

(10) Patent No.: US 6,220,015 B1
(45) Date of Patent: Apr. 24, 2001

(54) GAS-TURBINE ENGINE COMBUSTION SYSTEM

(75) Inventor: Theodors Ishaq Mina, Lincoln (GB)

(73) Assignee: Alstom Gas Turbines, Ltd. (GB)

( * ) Notice: Subject to any disclaimer, the term of this patent is extended or adjusted under 35 U.S.C. 154(b) by 0 days.

(21) Appl. No.: 09/351,193

(22) Filed: Jul. 9, 1999

(30) Foreign Application Priority Data

Jul. 11, 1998 (GB) ..... 9814975

(51) Int. Cl.[7] ..... F23R 7/00
(52) U.S. Cl. ..... 60/39.37; 60/39.31
(58) Field of Search ..... 60/39.37, 39.31; 417/174

(56) References Cited

U.S. PATENT DOCUMENTS

| | | | | |
|---|---|---|---|---|
| 2,722,803 | * | 11/1955 | Travers | 60/39.37 |
| 3,001,366 | * | 9/1961 | Shutts | 60/39.37 |
| 3,811,274 | | 5/1974 | Calderon | 60/39.32 |
| 3,991,560 | * | 11/1976 | DeCorso et al. | 60/39.32 |
| 4,249,372 | * | 2/1981 | White | 60/39.32 |
| 5,001,896 | | 3/1991 | Hilt et al. | 60/39.32 |
| 5,265,413 | * | 11/1993 | Cannon et al. | 60/39.32 |
| 5,361,577 | * | 11/1994 | Cromer | 60/39.32 |
| 5,402,635 | | 4/1995 | Smith et al. | 60/39.37 |
| 5,896,742 | * | 4/1999 | Black et al. | 60/39.37 |

FOREIGN PATENT DOCUMENTS 0 503 018 B1 12/1995 (EP) .

* cited by examiner

*Primary Examiner*—Charles G. Freay
*Assistant Examiner*—Robert Z. Evora
(74) *Attorney, Agent, or Firm*—Kirschstein et al.

(57) ABSTRACT

A gas-turbine engine combustion system comprises a plurality of combustors interconnected by crossfire tube assemblies adapted to pass an ignition flame from an ignited combustor to another combustor on start-up of the engine. Each crossfire tube assembly comprises a cooling air inlet for introducing air into the assembly to film-cool its inner, ignition flame-facing surface, and a cooling sleeve surrounding the crossfire tube assembly in the region in which it opens into the combustor. The cooling sleeve directs the cooling air so as to cool the outer surface of the assembly, the inside of the sleeve and the inside surface of the combustor wall adjacent the cooling sleeve.

10 Claims, 2 Drawing Sheets

GAS-TURBINE ENGINE COMBUSTION SYSTEM

BACKGROUND OF THE INVENTION

1. Field of the Invention

This invention relates to gas-turbine engine combustion systems, and in particular to combustion systems in which combustion chambers are interconnected by crossfire tubes for ignition purposes.

2. Description of the Related Art

In a typical industrial gas-turbine engine, a number of combustion chambers (hereinafter referred to as combustors) are arranged in parallel around the engine to receive the pressurized air flow from the compressor stage as oxidant for gaseous or liquid fuel which is burnt therein. For example, there may be six to eight combustors equiangularly spaced around the engine's centerline at a given radial distance therefrom. To avoid the need for igniters in every combustor to initiate combustion on start-up, it has become common practice to interconnect the combustors with tubes, called crossfire tubes, which are adapted to pass a flame from an ignited combustor to another combustor. A problem that has been experienced with this type of arrangement is that of the crossfire tubes or the combustors becoming damaged by the flow of hot gases during normal running after start-up. One way of reducing this problem is disclosed and claimed in our European Patent No. 0 503 018. In this arrangement, air is introduced into the crossfire tube in such a manner as to be constrained to flow over the inner surface of the crossfire tube adjacent to its connection with the combustor, thereby cooling the crossfire tube without adversely affecting the cross-lighting performance, and so extending its working life.

Although this arrangement has proved to be a significant improvement over earlier crossfire tube designs, it has been found in practice that there remains a possibility of overheating of the combustor wall adjacent to the position where the crossfire tube enters it.

U.S. Pat. No. 5,001,896 discloses a crossfire tube assembly for interconnecting combustors, in which a double-walled crossfire tube is used, the outer wall being perforated to admit cooling air into the space between the walls, and the inner wall also being provided with apertures to bleed some air into the gas flow within the crossfire tube. The outer wall fits into an annular flange projecting through the combustor wall and inwardly into the combustor, while the inner wall of the crossfire tube projects beyond its outer wall into the flange. Although this arrangement improves cooling of the tube, there is still a problem with localized heating of the inwardly directed flange, as well as the combustor wall surrounding it, and the inner wall of the interconnecting tube where it projects into the flange. In extreme conditions, this localized heating might cause failure of these components, resulting in fragments of metal being propelled into the turbine, possibly in turn causing its failure. While the risks of such a major failure are very low, the likelihood of early failure of the combustor through overheating around the flange is considerably higher.

The present invention seeks to avoid these problems and therefore to improve life expectancy of the combustion system.

SUMMARY OF THE INVENTION

According to the invention there is provided a gas-turbine engine combustion system in which adjacent combustors are connected by a crossfire tube assembly adapted to pass an ignition flame from an ignited combustor to another combustor, wherein each crossfire tube assembly comprises inlet means for introducing air to film-cool an inner ignition flame-facing surface of the crossfire tube assembly, characterized by cooling means surrounding the crossfire tube assembly at its connection to a combustor and adapted to film-cool an outer surface of the crossfire tube assembly, thereby creating film cooling over both inner and outer surfaces of the crossfire tube assembly.

Also according to the invention there is provided a gas-turbine engine combustion system comprising:

a plurality of combustors, a crossfire tube assembly for passing an ignition flame between adjacent combustors, each crossfire tube assembly including an end-tube for passing the ignition flame into and out of a combustor, the end-tube having an inner surface and an outer surface, and means for feeding coolant air into the crossfire tube assembly so as to film-cool the inner surface of the end-tube.

The invention is characterized in that the end-tube is connected to the combustor through a sleeve which extends from a wall of the combustor to surround and overlap the end-tube over a part of its length adjacent the combustor, thereby to define an annular gap between the outer surface of the end-tube and an inner surface of the sleeve, the sleeve having inlet means for introducing coolant air into the annular gap so as to film-cool both the outer surface of the end-tube adjacent the combustor wall and the inner surface of the sleeve.

Preferably, the sleeve is provided with a plurality of apertures therearound, adjacent to a point at which the sleeve is connected to the end-tube, so that air is admitted to film-cool the outer surface of the end-tube.

Preferably, each end-tube is arranged so that it does not extend beyond the sleeve into the interior of the combustor. More preferably, the overlap between the sleeve and the end-tube does not extend over the entire lengthwise extent of the sleeve, whereby there is a gap between an internal surface of the combustor wall and the end-tube. It has been found that good performance is obtained if the lengthwise extending gap as measured between the end-tube and an inner surface of the combustor wall is approximately twice the annular gap between the inner surface of the sleeve and the outer surface of the end-tube.

The sleeve is also preferably arranged not to project into the combustor, whereby cooling air exits from the sleeve over an inner surface of the combustor wall surrounding the sleeve.

The crossfire tube assembly preferably comprises an arrangement of the type disclosed in European Patent No. 0 503 018, in which a complete crossfire tube arrangement extending between first and second combustors comprises a central crossfire tube portion and first and second end-tubes extending from the first and second combustors respectively, a first end of the central crossfire tube portion being welded into the first end-tube and a second end of the central crossfire tube portion being a push-fit into the second end-tube, cooling air being directed into an annular gap formed between an outer surface of the central crossfire tube portion and an inner surface of each end-tube to film-cool the ends of the central crossfire tube portion and the inner surfaces of the end-tubes.

The present invention also includes a gas turbine incorporating the above combustion system.

DETAILED DESCRIPTION OF THE INVENTION

Figure 1:
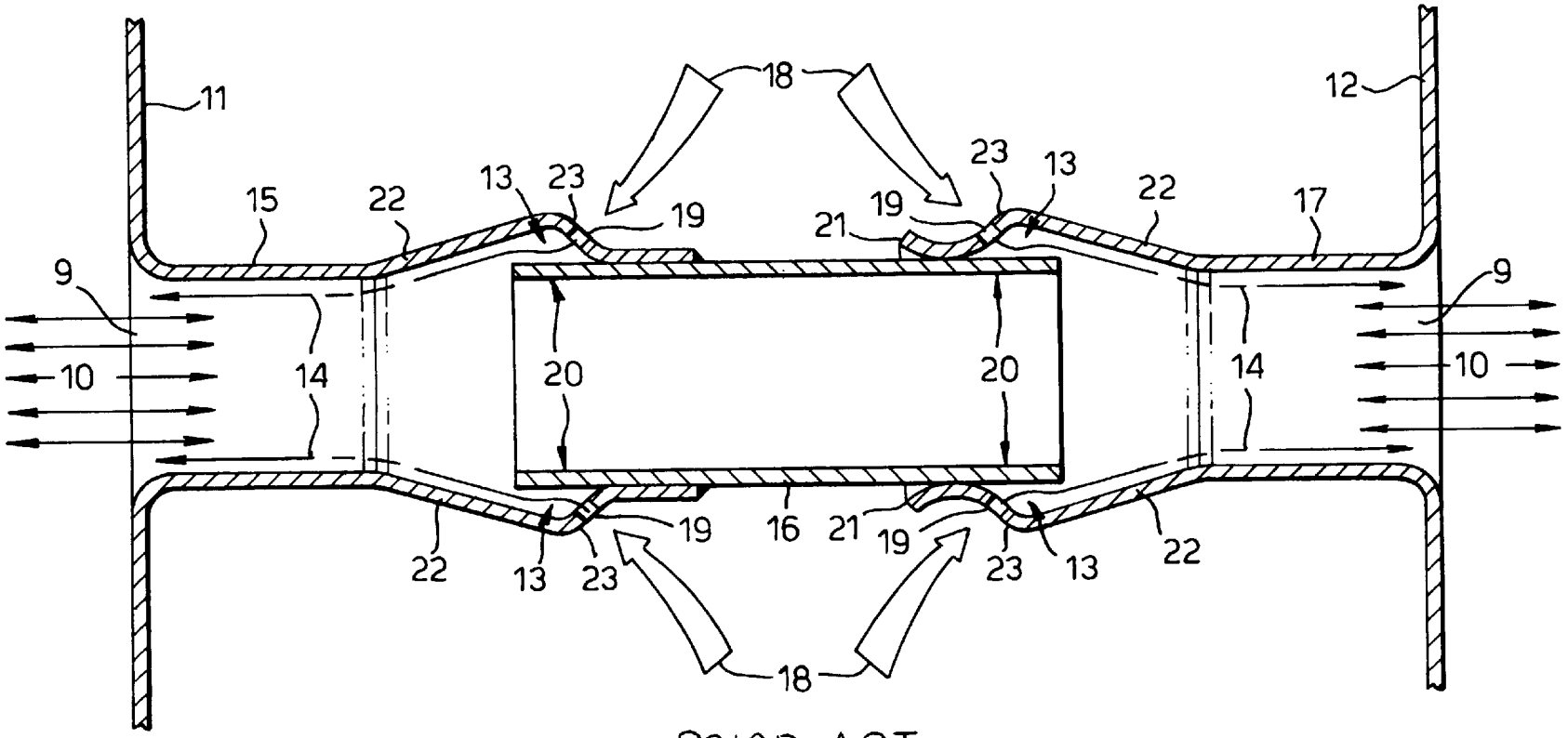
Fig.1. PRIOR ART
FIG. 1 reproduces FIG. 2 of European Patent No. 0 503 018 as prior art.

FIG. 1 shows a sectional view of part of a gas turbine combustion system in accordance with the prior art of European Patent No. 0 503 018. A crossfire tube assembly extends between adjacent combustor walls 11 and 12 and comprises a central crossfire tube portion 16 which at its left-hand end is welded into an end-tube 15 extending from combustor wall 11 and at its right-hand end is a push-fit into an end-tube 17 extending from an adjacent combustor wall 12. Cooling air 18 is directed through holes 19 into an annular gap or duct 13 formed between the outer surface at each end of the central crossfire tube portion 16 and the inner surface of a flared portion 22 of each end-tube to film-cool the ends 20 of the central crossfire tube portion 16 and the inner surfaces of the end-tubes 15, 17. For further details of this prior art, the published specification should be consulted, and is hereby incorporated by reference herein.

Figure 2:
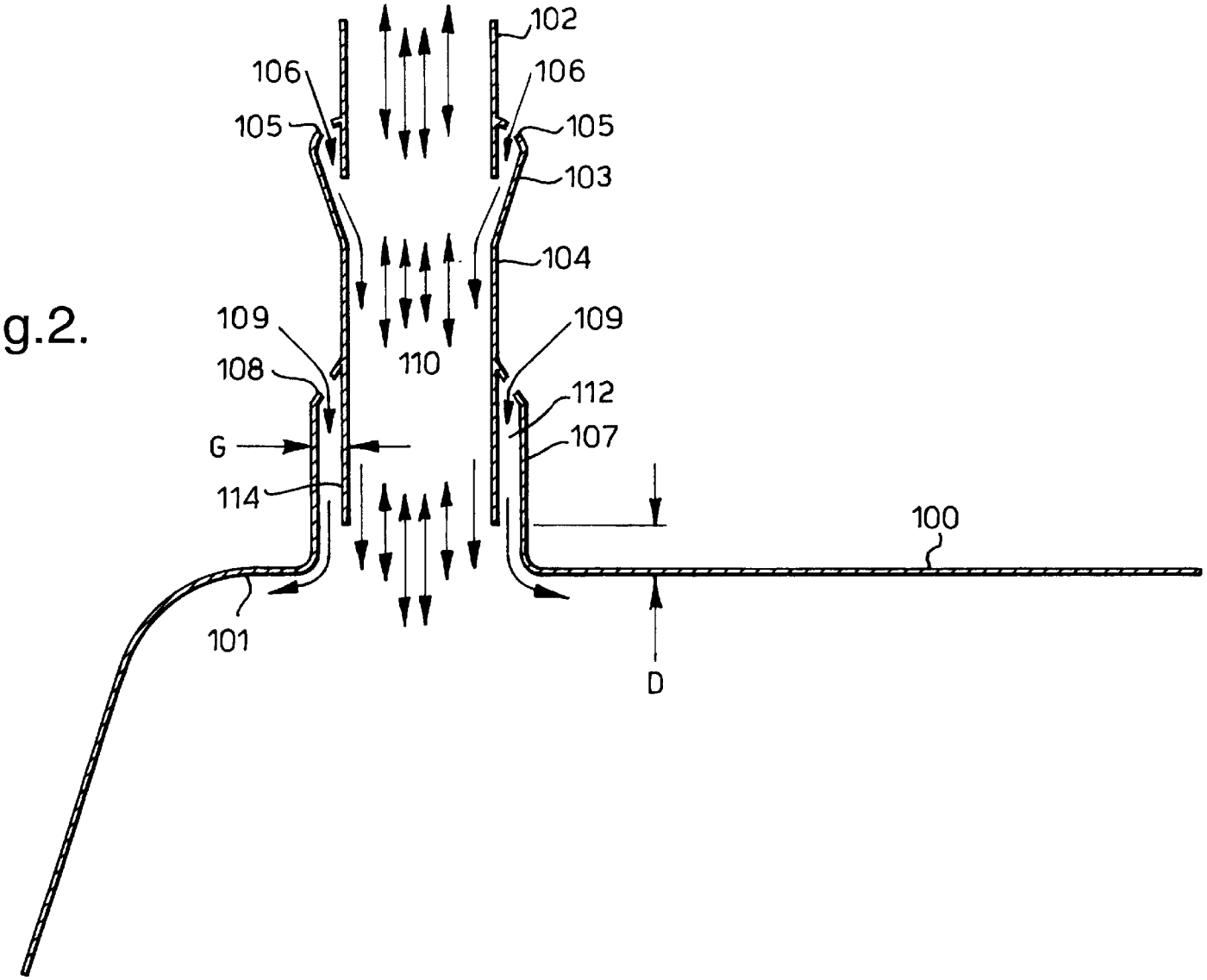
FIG. 2 illustrates in diagrammatic cross-section half of a crossfire tube assembly according to an exemplary embodiment of the invention.

FIG. 2 shows half a crossfire tube assembly on one side of a combustor 100, extending from the combustor wall 101 towards an adjacent combustor (not shown). It will be appreciated from FIG. 1 that each combustor has a male part-assembly on one side and a female part-assembly on the opposite side, the two part-assemblies fitting together to form the complete assembly. The central tube 102 is shown in part only; its connection to the next part-assembly being essentially the same as in European Patent No. 0 503 018.

The central tube 102 is welded into a flared portion 103 of an end-tube 104. Apertures 105 around the flared portion adjacent to the weld admit a cooling airflow 106. An annular nozzle, formed between the flared portion 103 and the free end of the central tube 102, directs the flow 106 along the inner surface of the end-tube 104 to cool the surface and protect it in use from the full heating effect of the flame in the tube. An outer coolant tube is formed as a socket or sleeve 107 into which the end-tube 104 is welded in such a manner that an annular gap space 112 is present at the overlap between the inner surface of the sleeve 107 and the outer surface of the end-tube 104. The outer cooling sleeve 107 is attached to the wall 101 of the combustor 100 by welding so as to become an integral extension of the combustor wall, or by means of a bolted flange or any other suitable attachment means.

A plurality of inlet holes 108 is formed around and adjacent to the welded connection between the outer sleeve 107 and the end-tube 104 to admit cooling air 109 into the annular gap space 112 between them. The cooling air 109 flows over the external surface of the end-tube 104, thereby cooling it, and enters the combustor 100 to flow inwardly over the inner surface of combustor wall 101, thereby creating a cooling effect at the connection between the combustor wall and the outer coolant sleeve 107, as well as at the end 114 of the end-tube 104.

It should be noted that the overlap between the sleeve and the end-tube does not extend over the entire lengthwise extent of the sleeve, end 114 of the end-tube 104 being located at a distance D outwardly of the inner surface of combustor wall 101. We have found that this gap distance D is preferably approximately twice the annular gap distance G between the inner surface of the sleeve 107 and the outer surface of the end-tube 104. This avoids exposing the end 114 of the end-tube 104 to the full heat of the combustion process in the interior of the combustor 100.

Furthermore, an ignition flame 110 passing through the crossfire tube assembly at start-up to ignite the next combustor is separated from the ignition flame-facing surface of the metal end-tube by an internal cooling air film which does not interfere with the passage of the flame. The cooling flow is always towards the combustor and thus towards the highest temperature regions. As a result, the temperature of the interconnecting crossfire tube assembly is reduced, thereby extending its life, and the risk of heat damage to the end of the crossfire tube assembly closest to the combustor is substantially reduced.

It will be understood that each of the elements described above, or two or more together, also may find a useful application in other types of constructions differing from the types described above.

While the invention has been illustrated and described as embodied in a gas-turbine engine combustion system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims.

I claim:

1. A gas-turbine engine combustion system comprising:

a plurality of combustors, a crossfire tube assembly for passing an ignition flame between adjacent combustors, each crossfire tube assembly including an end-tube for passing the ignition flame into and out of a combustor, the end-tube having an inner surface and an outer surface, and means for feeding coolant air into the crossfire tube assembly so as to film-cool the inner surface of the end-tube, wherein the end-tube is connected to the combustor through a sleeve which extends from a wall of the combustor to surround and overlap the end-tube over a part of its length adjacent the combustor, thereby to define an annular gap between the outer surface of the end-tube and an inner surface of the sleeve, the sleeve having inlet means for introducing coolant air into the annular gap so as to film-cool both the outer surface of the end-tube adjacent the combustor wall and the inner surface of the sleeve.

2. The gas-turbine engine combustion system according to claim 1, in which the sleeve is provided with a plurality of apertures therearound, adjacent to a point at which the sleeve is connected to the end-tube, so that air is admitted to film-cool the outer surface of the end-tube.

3. The gas-turbine engine combustion system according to claim 1, in which the end-tube is arranged so that it does not extend beyond the sleeve into the interior of the combustor.

4. The gas-turbine engine combustion system according to claim 1, in which the overlap between the sleeve and the end-tube does not extend over the entire lengthwise extent of the sleeve, whereby there is a gap between an internal surface of the combustor wall and the end-tube.

5. The gas-turbine engine combustion system according to claim 4, in which the gap as measured between the end-tube and an inner surface of the combustor wall is approximately twice the annular gap between the inner surface of the sleeve and the outer surface of the end-tube.

6. The gas-turbine engine combustion system according to claim 1, in which the sleeve is arranged such that cooling air exits from the sleeve over an inner surface of the combustor wall surrounding the sleeve.

7. The gas-turbine engine combustion system according to claim 1, in which a complete crossfire tube arrangement extending between first and second combustors comprises a central crossfire tube portion and first and second end-tubes extending from the first and second combustors respectively, a first end of the central crossfire tube portion being welded into the first end-tube and a second end of the central crossfire tube portion being a push-fit into the second end-tube, cooling air being directed into an annular gap formed between an outer surface of the central crossfire tube portion and an inner surface of each end-tube to film-cool the ends of the central crossfire tube portion and the inner surfaces of the end-tubes.

8. A gas-turbine engine combustion system in which adjacent combustors are connected by a crossfire tube assembly adapted to pass an ignition flame from an ignited combustor to another combustor, wherein each crossfire tube assembly comprises inlet means for introducing air to film-cool an inner ignition flame-facing surface of the crossfire tube assembly and cooling means surrounding the crossfire tube assembly at its connection to a combustor and adapted to film-cool an outer surface of the crossfire tube assembly, thereby creating film cooling over both inner and outer surfaces of the crossfire tube assembly.

9. The gas-turbine engine combustion system according to claim 8, in which a complete crossfire tube arrangement extending between first and second combustors comprises a central crossfire tube portion and first and second end-tubes extending from the first and second combustors respectively, a first end of the central crossfire tube portion being welded into the first end-tube and a second end of the central crossfire tube portion being a push-fit into the second end-tube, cooling air being directed into an annular gap formed between an outer surface of the central crossfire tube portion and an inner surface of each end-tube to film-cool the ends of the central crossfire tube portion and the inner surfaces of the end-tubes.

10. The gas-turbine engine having a combustion system according to claim 1.

* * * * *